United States Patent [19]

Campbell et al.

[11] 4,428,106

[45] Jan. 31, 1984

[54] METHOD OF MAKING DOUBLE WALL TUBING ASSEMBLY

[75] Inventors: Bonnie J. Campbell; Thomas G. Counts; James L. Cunningham; Karl J. Youtsey, all of Decatur, Ala.

[73] Assignee: UOP Inc., Des Plaines, Ill.

[21] Appl. No.: 371,919

[22] Filed: Apr. 26, 1982

Related U.S. Application Data

[62] Division of Ser. No. 930,942, Aug. 4, 1978, Pat. No. 4,343,360.

[51] Int. Cl.[3] ..... B21D 53/00

[52] U.S. Cl. ..... 29/157.3 A; 29/157.3 AH; 29/157.3 B; 165/11 R; 165/70; 165/179

[58] Field of Search ..... 165/11, 70, 134 R, 179, 165/181; 29/157.3 A, 157.3 AH, 157.3 B

[56] References Cited

U.S. PATENT DOCUMENTS

| | | | |
|---|---|---|---|
| 2,913,009 | 11/1959 | Kuthe | 29/157.3 AH |
| 3,683,656 | 8/1972 | Lewis | 72/98 |
| 3,768,290 | 10/1973 | Zatell | 29/157.3 AH |
| 3,768,291 | 10/1973 | Rieger | 165/179 |

FOREIGN PATENT DOCUMENTS

| | | | |
|---|---|---|---|
| 606284 | 12/1946 | United Kingdom | 165/70 |
| 1145513 | 3/1969 | United Kingdom | 165/70 |

*Primary Examiner*—Francis S. Husar
*Assistant Examiner*—David B. Jones
*Attorney, Agent, or Firm*—James R. Hoatson, Jr.; Barry L. Clark; William H. Page, II

[57] ABSTRACT

Improved double wall tubing assembly which is especially useful in heat exchangers of the "coil-in-can" type for solar applications has a double wall construction which insures that a leak developing from a failure in either of the walls will not result in a mixing of fluid external to the outer tube with the fluid flowing internally of the inner tube. An outwardly projecting helical fin configuration formed on the outer surface of the inner tube provides an effective heat transfer medium between the inner and outer walls of the tube assembly while defining a spiral flow channel through which leakage entering through either wall can flow and be detected. A method of making the double wall tube assembly is disclosed wherein a finned outer tube is assembled over a previously finned inner tube. The assembled tubes are then brought into firm mechanical contact by the step of forming the assembled tubes into a coil and/or by expanding the inner tube. An additional method is also disclosed wherein a plain outer tube is assembled over a previously formed inner tube and then contacted by finning tools which fin its outer surface and bring its inner diameter into intimate contact with the inner tube.

3 Claims, 4 Drawing Figures

METHOD OF MAKING DOUBLE WALL TUBING ASSEMBLY

This is a division of application Ser. No. 930,942, filed Aug. 4, 1978 and now U.S. Pat. No. 4,343,360.

BACKGROUND OF THE INVENTION

The invention relates to heat exchange tubing and particularly to heat exchange tubing for use in solar applications where, for example, a can or shell member might have drinking quality water flowing through it to be heated by an internal heat exchange coil through which an ethylene glycol solution, for example, is circulated. The coil is typically in series with the flow channels of a solar collector element. In order to insure that the liquid in the can and the liquid in the coil do not mix in the event of a tube wall failure it has been proposed that the coil comprise a double wall tube. Although a double walled tube having its two walls in complete, intimate contact throughout their length would seem to provide good heat transfer, although not as good as a single wall tube, such a design would not enable one to tell when an opening in either wall developed. Thus, it is necessary to provide a space between the walls through which leakage through an opening in either wall can flow. However, the existence of such a space could be expected to reduce the heat transfer efficiency of the coil. Thamasett et al U.S. Pat. No. 3,830,290 illustrates the use of pyramid-shaped spacers on at least one of a pair of concentric pipes and a leakage indicator means sensitive to an increase in pressure in the leakage space between the pair of pipes. The pipes are plain and have no surface enhancement features. Kuthe U.S. Pat. No. 2,913,009 and Nakayama Canadian Pat. No. 736,374 each show composite tube assemblies with the outer tube having external fins and the inner tube having an enhanced inner surface to increase turbulence. In each case, the tube assemblies are designed to enhance internal and external heat transfer and there is no suggestion of a flow channel for leakage between the tubes. Thus, one would never know it if one or the other tube developed an opening through its wall. In Kuthe, the tubes have contacting plain sections at their ends which would prevent any flow from between the tubes and thus would prevent their use as leak detectors. In Nakayama, there is no space between the tubes in the FIG. 3 embodiment and the patentee suggests that the groove 6 could be filled with heat conducting material, thus preventing leakage detection.

SUMMARY OF THE INVENTION

It is among the objects of the present invention to provide a double wall heat exchange tube which will enable the detection of leaks through any point in either wall while providing good heat transfer. It is another object of the invention to provide various methods of producing such a tube.

These and other objects are obtained by the heat exchange tube assembly and methods for making same of the present invention. The assembly comprises a composite consisting of a helically finned inner tube and a helically finned outer tube with at least the inner tube having a turbulence inducing inner surface. The external fins on the inner tube are bent over with the inner surface of the bent over tip portions defining one side of a helical flow channel through which leaking fluid can travel. The outer surfaces of the bent over tips portions engage the inner surface of the externally finned outer tube and transfer heat thereto. When the inner wall of the outer tube is smooth, the bent over fin tips may tightly contact the major portion of the inner surface. Thus, it is possible that a pin-hole failure in the outer tube could be blocked by a fin tip on the inner tube. Such a situation would not substantially affect the integrity of the leak detection system, however, since the fin tips are very thin relative to the thickness of the tube wall. Thus, even if the hole in the outer tube permitted erosion in the underlying fin tip the erosion would permit the leak to reach the flow channel where it could be detected long before any damage was done to the wall of the inner tube. For example, the fin tip might merely develop a hole which would permit direct access of the leak to the channel. It might also be eroded slightly in thickness to a point where leakage could flow around it or where it would slightly collapse. Where the outer finned tube is formed with a helical groove in its inner surface the helical groove will provide a secondary flow channel for leakage.

The double wall tube assembly of the invention is of particular utility in a "coil-in-can" type of heat exchanger such as used in solar applications. The coiled section of the tubing fits in a spun metal can and has straight ends extending out of the top and bottom of the can. The outer tubing is only required to surround the inner tubing as the latter passes through the can and thus needs to be very little longer than the length of the can and its fittings. Both tubes preferably have a smooth unfinned configuration in the region of the ends of the can so that they can be spun into contact with the can and then brazed or otherwise sealed thereto. The space between the inner and outer tubes may be left open at one end so that any leakage fluid may flow out and be visually detected. Alternatively, an alarm system can be connected to the tubes so that the presence of liquid in the leakage flow channel can be detected without the need to visually observe for leaks. Such a system might include a felted pad for example which has been impregnated with an electrolyte such as sodium chloride. When the pad becomes wet, an electrical current can flow between a pair of switch plate members on either side of the pad and activate a horn or light for example. A suitable horn for such a system would be the one found in smoke alarms.

DESCRIPTION OF THE PREFERRED EMBODIMENT

Figure 1:
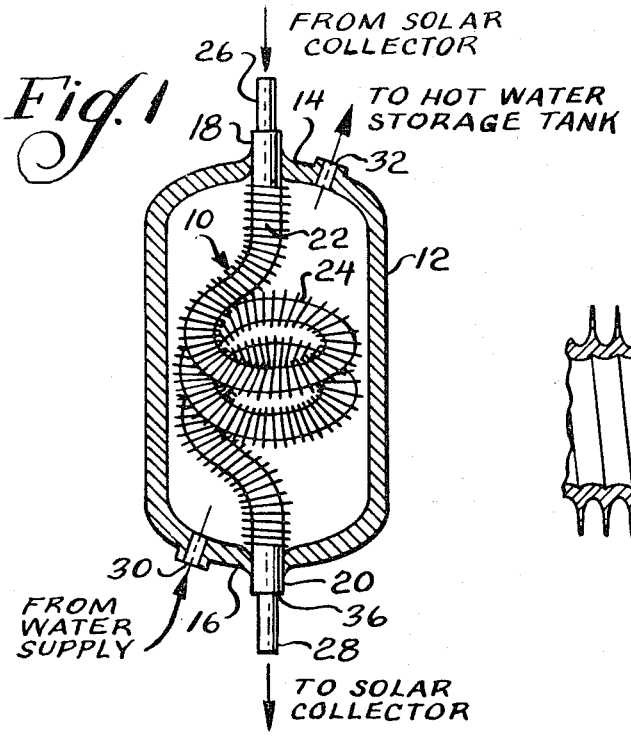
FIG. 1 is a side view, partly in section, of a coil-in-can heat exchanger utilizing our improved double wall tubing assembly.

Referring to FIG. 1, our improved double wall heat exchanger tube assembly is indicated generally at 10 in assembled relationship with a metal can or shell member 12 which preferably comprises a cylinder of copper which has been spun at its ends while the assembly 10 is inside to form a small upper aperture 14 and lower aperture 16 which tightly engage the upper and lower end portions 18, 20, respectively, of the outer tube portion 22 of the tube assembly 10. The end tube portions 18, 20 are preferably smooth and unfinned so as to facilitate their being brazed to the can ends 14, 16. In order to maximize the amount of heat exchange tubing 10 located within the shell 12, and thus the overall heat transfer capability of the unit, the tubing 10 is formed so as to include a coil portion 24 which preferably has an outer diameter only slightly less than the internal diameter of the can or shell member 12. In use, flow to the solar collector unit is in a counterflow arrangement so that flow into the upper end portion 26 of the internal tube member 40 (FIG. 4) from a solar collector unit (not shown) will pass downwardly, for example, through the inner tube member 40 and exit from its lower end portion 28 from whence it will be circulated back to the solar collector inlet. Water to be heated by the heat exchange tube assembly 10 will be piped into the can 12 through inlet opening 30 from a water supply and will exit through an outlet opening 32 at the upper end of the can to a hot water storage tank (not shown). The upper end 18 of the outer tube 22 is preferably brazed so as to be sealed to the end portion 26 of the inner tube as well as to the aperture 14 in the can 12. However, the lower end 20 of the outer tube is preferably not sealed to the end portion 28 of the inner tube so as to leave an exit opening 36 between the tubes through which water may flow in the event a leak develops through the wall of either tube as it passes through the can member 12. The configuration of the flow channel which leads to opening 36 will be described more fully in connection with the description of FIG. 4.

Figure 2:
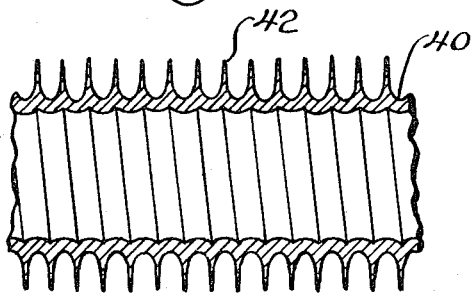
FIG. 2 is an enlarged axial cross-section view of a portion of the length of finned tubing used to form the inner member of the double wall tubing assembly.
Figure 3:
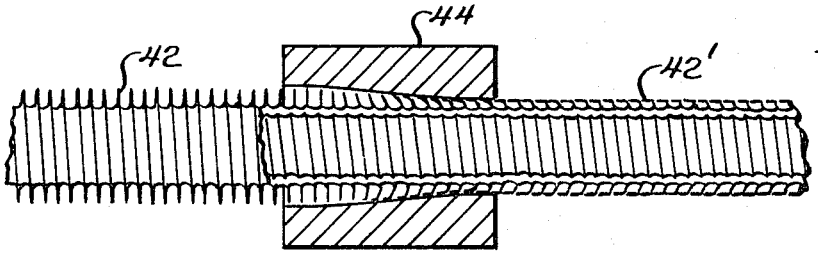
FIG. 3 is a side, partially sectioned view of the tubing of FIG. 2 being drawn through a die to bend over the outer tip portions of its fins.
Figure 4:
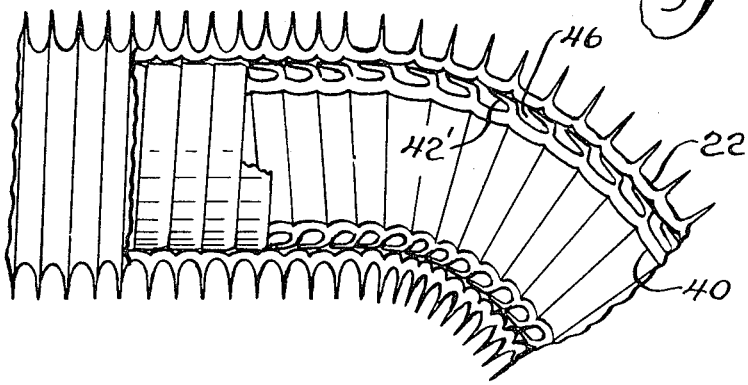
FIG. 4 is a side, partially sectioned view showing the tubing produced by the operation of FIG. 3 in assembled internal relationship to an outer finned tube with the assembly being coiled to increase the contact between the two tubes.

The tube assembly 10 includes an inner finned tube member 40 telescopically positioned inside an outer fin tube member 22 in the manner shown in FIG. 4. The inner tube member 40 is initially formed so as to have helical radial fins 42 as shown in FIG. 2. To enhance the contact of the fins 42 with the inner wall of tube 22 the fin tips 42' are bent over generally parallel with the tube axis by passing the tube through a die means 44 as shown in FIG. 3. It is the product emanating from the die 44 which is then inserted into the tube 22 shown in FIG. 4. As can be seen in FIG. 4, the bent over fin tip portions 42' cooperate with the outer surface of the tube wall 40 and with the radial edge surfaces of two adjacent fins to form a helical channel 46 which extends for the entire length of the finned portion of the inner tube. It is this channel 46 which carries leakage from a hole which might develop in either the tube wall 40 or the tube wall 22. The leakage which enters the channel 46 will then easily find its way to the opening 36 where it can be detected either as a series of drips or by a more sophisticated means such as a pressure indicator or the aforementioned switch device in which the contacts of an alarm device are electrically connected by the flow of water from the channel 46 onto a normally dry electrolyte impregnated member positioned between the contacts.

We have found that in performing the step of coiling the inner and outer tube members 40, 22 to produce the configuration shown in FIG. 1 that the fin tip portions 42' tend to be forced radially outwardly into contact with the inner wall of the outer tube 22, thus increasing the mechanical bond and the efficiency of the heat transfer.

In a laboratory heat transfer test a comparison was made between a coil-in-can heat exchanger made in accordance with the present invention and similar units of conventional construction. One such unit contained a coil having a single wall and the other unit contained a double wall coil having a plain tube liner. It was expected that the single wall coil would provide superior heat transfer and this was found to be the case. It was also expected that the double wall coil having the plain tube liner would out perform the new design with the lead detecting feature since the plain tube liner provides for full and continuous contact between the tube walls of the two tubes. Surprisingly, the double wall coil having the finned tube liner gave heat transfer results equal and in fact slightly better than the assembly with the plain tube liner. Thus, the test proved that the provision of a rather large space between the tube walls in which leaked fluid could flow so as to be detected would not detract from the heat transfer performance provided by a double tube assembly where the walls are in full contact but there is no provision for leak detection. The overall coefficient of heat transfer, $U_o$, was found to be 64.7 Btu/hr-ft$^2$-°F. for the single wall coil, 24.9 for the double wall coil having the plain tube liner and 26.1 for our improved double wall coil having the leak detecting finned tube liner. In each case, the coils were identical and contained 16 linear feet of finned tube. The cans or shells were 3" O.D. and were about 25¼" long. The outer finned tube had an outer diameter of 1.125".

Although we prefer to make the double wall tube assembly illustrated in FIG. 4 by telescoping two finned tubes together, it is also contemplated that the assembly can be made by placing a finned inner tube inside a plane or unfinned outer tube which would then be finned, with or without a mandrel, to mechanically bond it to the inner tube. The external finning operation causes the fins on the inner tube which have the configuration shown in FIG. 2 to bend over and form channels similar to channels 46 shown in FIG. 4. Alternatively, the inner fins could be pre-bent as shown in FIG. 3. A suitable finning apparatus is disclosed in U.S. Pat. No. 4,031,602, the disclosure of which is incorporated by reference herein.

We claim as our invention:

1. A method of making a double wall heat exchange tube coil with a between wall channel which can receive and carry leakage flow resulting from a failure in either wall comprising the steps of externally finning a first tube over at least a portion of its length to produce a plurality of closely spaced transverse fins and simultaneously producing a turbulence inducing configuration in its inner wall; externally finning a second tube having a larger diameter than the first tube over at least a portion of its length; bending the tips of the fins on the first tube so they are directed generally axially of the tube and are spaced from the wall of the tube so as to define a generally enclosed space having the tube wall at its base, the bent over fin tip at its top and the radially extending walls of two adjacent fins at its sides; inserting the first tube within the second tube so that a finned portion of the second tube will closely overlie a finned portion of the first tube; and forming the composite assembly of tubes into a coil over at least a portion of its length, thereby forcing the inner wall of the second tube into tight mechanical engagement with the bent over fin tips of the first tube.

2. A method in accordance with claim 1 and further comprising applying fluid pressure to the interior of the first tube as it is formed into a coil to slightly expand the first tube and enhance its mechanical engagement with the inner wall of the second tube.

3. A method of making a double wall heat exchange tube with a between wall channel which can receive and carry leakage flow resulting from a failure in either wall comprising the steps of externally finning a first tube over at least a portion of its length to produce a plurality of closely spaced transverse fins and simultaneously producing a turbulence inducing configuration in its inner wall; placing a second plain, unfinned tube having a larger diameter than the first tube in telescopic relation with the first tube over at least a portion of the length of the first tube; finning the outer wall of the second tube over at least a portion of its length so as to reduce its inside diameter and cause the tips of the fins on the inner tube to bend over and define a generally enclosed helical channel having the tube wall at its base, the bent over fin tips at its top and the radially extending walls of adjacent fins at its sides.

* * * * *